United States Patent [19]

Scopatz

[11] Patent Number: 4,632,254

[45] Date of Patent: Dec. 30, 1986

[54] METHOD FOR ADJUSTING WEIGHT BREAKS REACTIVE TO CHANGES IN DISTRIBUTION OF OBJECT WEIGHT

[75] Inventor: Stephen D. Scopatz, Three Rivers, Calif.

[73] Assignee: Pennwalt Corporation, Philadelphia, Pa.

[21] Appl. No.: 680,875

[22] Filed: Dec. 12, 1984

Related U.S. Application Data

[63] Continuation of Ser. No. 584,373, Feb. 28, 1984, abandoned.

[51] Int. Cl.[4] ..... B07C 5/28

[52] U.S. Cl. ..... 209/592; 53/502; 177/25; 364/567; 364/571

[58] Field of Search ..... 209/592–596; 364/567, 568, 571, 579, 580, 466; 177/25, 1; 53/502

[56] References Cited

U.S. PATENT DOCUMENTS

| | | | |
|---|---|---|---|
| 4,106,628 | 8/1978 | Warkentin | 209/592 |
| 4,336,853 | 6/1982 | Hirano | 209/592 |
| 4,413,739 | 8/1983 | Kohashi | 209/592 |
| 4,482,061 | 11/1984 | Leverett | 209/592 |
| 4,483,047 | 11/1984 | Linville, Jr. | 364/567 |

*Primary Examiner*—Robert B. Reeves
*Assistant Examiner*—Donald T. Hajec
*Attorney, Agent, or Firm*—Seidel, Gonda, Goldhammer & Abbott

[57] ABSTRACT

A method of operating an article sorting machine automatically adjusts weight cutoff values defining size grades to compensate for variations in weight distribution of the articles. The method comprises the steps of monitoring the actual average weight of the articles classified into each size grade, periodically comparing the actual average weight of the articles classified into each size grade to values indicative of the desired average weight of the articles classified into each size grade, and modifying ones of the weight cutoff values if the actual average weight of the articles classified into selected ones of the size grades differs from the desired average weight of the articles to be classified into the selected ones of the size grades.

14 Claims, 6 Drawing Figures

| | SIZE | DESIRED PKG COUNT (BC) | DESIRED PKG WT (BL) | WEIGHT CUTOFF VALUE (M) |
|---|---|---|---|---|
| | 1 | BULK | 40.00LB | 0.050LB |
| | 2 | BULK | 40.00LB | 0.100LB |
| | 3 | BULK | 40.00LB | 0.180 LB |
| | 4 | BULK | 40.00LB | 0.220LB |
| | 5 | 138 | 40.00LB | 0.279LB |
| F | 6 | 125 | 40.00LB | 0.294LB |
| DS | 7 | 113 | 41.00 LB | 0.346LB |
| | 8 | 100 | 40.00LB | 0.380LB |
| CS | 9 | 88 | 40.00 LB | 0.420LB |
| | 10 | 80 | 40.00LB | 0.489LB |
| DP | 11 | 72 | 40.00LB | 0.511 LB |
| | 12 | 64 | 40.00LB | 0.600LB |
| L | 13 | 56 | 40.00LB | 0.650LB |
| | 14 | 48 | 41.00 LB | 0.779LB |

METHOD FOR ADJUSTING WEIGHT BREAKS REACTIVE TO CHANGES IN DISTRIBUTION OF OBJECT WEIGHT

RELATED APPLICATION DATA

This is a continuation of co-pending patent application Ser. No. 584,373 filed Feb. 28, 1984, now abandoned.

BACKGROUND OF THE INVENTION

Electronic control systems for article sorting machines of the type which sort articles at ones of a plurality of discharge stations on the basis of the articles' weights are known. See U.S. Pat. No. 4,106,628 issued Aug. 15, 1978, incorporated herein by reference.

As is known in the art, in such sorting machines plural weight reference or weight cutoff values of successively increasing magnitude are selected and set into the controller by the operator. The range or differences between successive weight cutoff values define weight breaks or size grades into which the articles are to be classified. For example, the operator may desire to sort the articles into four weight breaks or size grades and accordingly will select four sequential weight cutoff values of successively increasing magnitude, defining the four weight breaks or size grades. These weight cutoff values are used by the controller to sort the articles into the various weight breaks on the basis of their actual weight.

It is often desirable to adjust the weight cutoff values during a sorting operation to maintain consistent package count and package weight throughout the sorting procedure. In prior art machines, this is achieved by manually readjusting the weight cutoff values during the sorting operation to account for variations in fruit weight. This requires that, during the sorting operation, the operator periodically sample package weight, calculate new weight cutoff values based upon the sample measurements, and input the new weight cutoff values into the control system. This manual sampling method often requires several minutes, and the weight distribution of the articles (which generally follows a Gaussian curve) may change dramatically in those few minutes. Drastic errors in package count and package weight may occur.

It is therefore desirable to provide a system which automatically adjusts the weight cutoff values during the sorting operation to achieve consistent package weight and package count throughout the sorting procedure.

SUMMARY OF THE INVENTION

A machine for sorting articles according to their weight by weighing each article, classifying each article into one of a plurality of size grades by comparing each article's weight to weight cutoff values defining the size grades and discharging each article at a selected one of a plurality of discharge stations based upon the article's size grade classification utilizes a method of automatically adjusting the weight cutoff values to compensate for variations in the weight distribution of the articles to be sorted. In its simplest form, the method comprises the steps of monitoring the actual average weight of the articles classified into each size grade, periodically comparing the actual average weight of the articles classified in each size grade to values indicative of the desired average weight of the articles to be classified into each size grade and modifying certain ones of the weight cutoff values if the actual average weight of the articles classified into selected ones of the size grades differs from the desired average weight of the articles to be classified into the selected ones of the size grades.

More specifically, the present invention is directed to a method of adjusting selected ones M(F) through M(L) of weight cutoff values M(N) defining plural weight breaks N into which articles are to be classified according to their actual weight WT, where N is an integer value greater than 1. The method is for use with an article sorting machine of the type having a scale over which the articles are transported for obtaining a measurement of each article's actual weight WT, a controller for determining into which one of the weight breaks N each article should be classified based on each article's actual measured weight WT, and a plurality of selectively actuatable discharge stations for discharging each article at a selected location based on its weight break classification for packaging the articles. The method comprising the steps of:

(a) providing via a user operable data entry means data indicative of desired package count BC and desired package weight BL of the articles to be packaged at each discharge location;

(b) designating a plurality of successive weight breaks, F through L, of the N weight breaks to be automatically controlled;

(c) computing the desired average weight AV of the articles to be classified into each of the weight breaks based upon the values of BL and BC;

(d) designating one of the weight breaks F through L as a control size, CS;

(e) providing an initial value representing the difference between the weight cutoff value M(CS) for the control size CS and the weight cutoff value M(CS+1) for the weight break CS+1 immediately succeeding the control size CS, the difference defining a control size gap width GC;

(f) determining initial weight cutoff values M(N) for each weight break N based upon the values of GC and AV;

(g) determining the difference between each weight cutoff value M(N+1) and the immediately preceding weight cutoff value M(N) and defining each difference as a gap width GW(N);

(h) comparing the actual weight WT to the weight cutoff values M(N) and classifying each article into one of the weight breaks N;

(i) maintaining a count CX of the actual number of articles classified into each weight break N and a running sum TW of the weight of the articles classified into each weight break;

(j) determining the first and last weight breaks, DS and DP respectively, between the weight breaks F and L, to have classified therein a pre-selected number MC of articles;

(k) computing the actual average weight CA of the articles classified into weight breaks DS through DP based upon the respective values of TW and CX, and computing the differences DF(N) between the desired average weights AV(N) and the actual average weight CA(N) for the articles classified into weight breaks DS through DP;

(l) modifying the weight cutoff values M(N) corresponding to the weight breaks DS through DP in accordance with the differences DF(N);

(m) determining the difference between each modified weight cutoff value M(N) and the immediately preceding modified weight cutoff value M(N−1) for the weight breaks between DS and DP and subtracting therefrom the gap width GW(N−1) corresponding to the immediately preceding weight cutoff value M(N−1), the result defining a deviation GG(N−1) corresponding to the weight break N−1;

(n) alternately adding and subtracting each of the deviations GG(N−1) for each weight break DS through DP and dividing the result by a multiple of the number of weight breaks between DS and DP inclusive, the result of the division defining a minimizing constant BB;

(o) remodifying the weight cutoff values M(DS) through M(DP) inclusive by alternately adding to and subtracting from each of the modified weight cutoff values M(DS) through M(DP) the value of the minimizing constant BB;

(p) defining a value WB by multiplying the desired package count BC(DS) for the weight break DS by the actual average weight CA(DS) for the the weight break DS and subtracting the result from a multiple of the desired box weight BL(DS) for the weight break DS;

(q) modifying the weight cutoff values M(F+1) through M(DS−1) corresponding to weight breaks F+1 through DS−1 by, for each such weight break, dividing the value of WB by the corresponding desired package count BC, obtaining a multiple of the result and subtracting therefrom the weight cutoff value M(N+1) for the immediately succeeding weight break N+1;

(r) modifying the weight cutoff values M(N) corresponding to weight breaks DP through L by, for each such weight break, adding the difference DF(DP) for weight break DP to the original value of M(N);

(s) discharging the articles at selected ones of the discharge stations based upon the weight breaks defined by the modified weight cutoff values and the actual weight of the articles.

DETAILED DESCRIPTION OF THE INVENTION

Figures 1, 5:
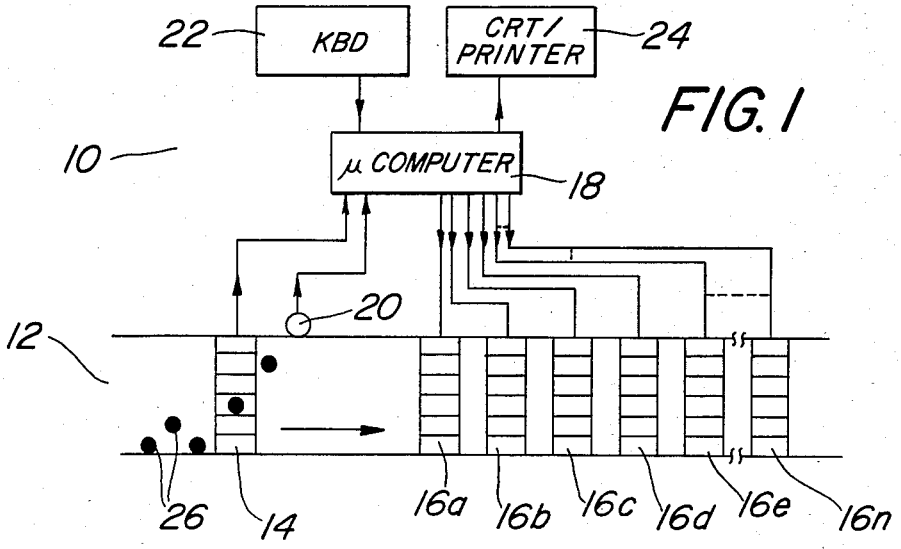
FIG. 1 is a block diagram of an electronically controlled article sorting apparatus.
FIG. 5 exemplifies selection of miscellaneous variables associated with the practice of the present invention, including selection of the control side, CS.

Referring now to the drawings wherein like numerals represent like elements, there is shown in FIG. 1 a block diagram of an electronically controlled article sorting apparatus, labeled generally 10. The details of sorting apparatus 10 are disclosed in more detail in aforementioned U.S. Pat. No. 4,106,628. The hardware functions disclosed in the aforementioned patent are performed by means of a microcomputer 18, suitably programmed using well known programming techniques.

Articles 26, such as fruit are conveyed onto a conveyor mechanism 12, then over an electronic weighing platform or scale 14. Scale 14 provides an electrical signal to microcomputer 18 indicative of the weight of the article 26 currently on the scale 14. Actually, the signal provided to microcomputer 18 by scale 14 has a magnitude indicative of the combined weight of article 26 and the cup in which article 26 is transported (as more fully explained in aforementioned U.S. Pat. No. 4,106,628). Microcomputer 18 is programmed to subtract the tare weight of the cup (stored in memory of microcomputer 18) from the combined weight of the cup and the article 26 to obtain the actual weight of the article 26 alone. Microcomputer 18 is also programmed to perform the equivalent hardware functions disclosed in aforementioned U.S. Pat. No. 4,106,628 of, inter alia, comparing the actual weight of articles 26 to the weight cutoff values for determining the proper weight break into which the article 26 should be classified for later sorting.

Articles 26 are then transported over a plurality of discharge stations **16*a*–16*n* where they are selectively discharged under control of microcomputer 18 according to the weight break into which they have been classified. The number of weight breaks programmed into computer 18 may correspond to the number of discharge locations 16*a*–16*n* in sorting machine 10. Thus for example, articles of a first size grade, e.g., size grade 1, may be discharged at location 16*a*, articles of a second size grade, e.g., size grade 2, may be discharged at location 16*b***, etc.

As articles 26 are transported on conveyor 12 from scale 14 to discharge locations **16*a*–16*n*, a shaft encoder 20 provides pulses to microcomputer 18 for the purpose of keeping track of the position of each article 26. In this manner, and as more fully explained in aforementioned U.S. Pat. No. 4,106,628, microcomputer 18 can determine when an article 26** is in position for discharging.

After the articles have been discharged, a take-away conveyor (not shown) may transport the articles to an automated packaging station.

Communicating with microcomputer 18 is a keyboard 22 and a CRT and/or printer 24. Data such as the weight cutoff values, desired package count and desired package weight may be entered into the memory of microcomputer 18 via keyboard 22. CRT/printer 24 echos the data entered via the keyboard 22 and may also provide production data, etc. to the operator.

The lower boundary of each weight break programmed into microcomputer 18 is determined by selecting, for each weight break, a weight cutoff value which an article's weight must equal or exceed to be classified into that particular weight break. For example, in an apparatus where there are four programmed weight breaks, the weight breaks will be defined by four weight cutoff values, each representing the minimum weight which an article must have to be classified into the corresponding weight break. It will be appreciated that the smallest or lowest weight break (i.e., that corresponding to articles having the smallest weight) will have the lowest weight cutoff value associated therewith, while the greatest weight break will have the highest weight cutoff value associated therewith. All weight breaks therebetween will have successively increasing weight cutoff values associated therewith.

It is often desirable to select the weight cutoff values so that a preselected number of articles classified within given weight breaks will always weigh substantially preselected amounts. For example, it may be desirable to program the weight breaks so that 100 articles of size grade 3 weigh 40 pounds. In this manner, packaging apparatus will always receive articles which have been sorted so that packages of uniform count and weight are produced. In the prior art, this process achieved by periodically and manually weighing a sample number of processed articles (i.e., articles which have already been sorted, calculating new weight cutoff values based on the sample data, then entering the new weight cutoff values into the controller. During this sample period, fluctuations in the average weight of articles entering the sorting machine may occur, providing undesirable sorting results. Moreover, because fluctuations in average article weight are likely to occur throughout the course of a sorting operation, the operator must go through the sampling and readjustment process many times each day. The present invention essentially eliminates this sampling and readjustment procedure.

FIGS. 2, 3, 4A and 4B explain in detail the operation of the inventive method.

As seen the method is divided into three routines. The INITIALIZE ROUTINE (FIG. 2) the RUN ROUTINE (FIG. 3) and the UPDATE ROUTINE (FIGS. 4A–4B). Generally, as explained hereinafter, the INITIALIZE ROUTINE is used to establish initial weight cutoff values M for each of a plurality N of weight breaks into which the articles are to be classified. During the INITIALIZE ROUTINE, the operator also selects a plurality of sequential weight breaks F (first) through L (last) which are to have their weight cutoff values automatically controlled. That is, the operator selects a plurality of sequential weight breaks between the first weight break, 1 and the last weight break, N, whose weight cutoff values are to be automatically modified during the article sorting process to account for fluctuations in average article weight. The range of weight breaks selected to be under automatic control is designated F–L.

The RUN ROUTINE compares the actual weight WT, of each article to the weight cutoff values M(N) and determines the weight break or size grade for that article. As is known in the art, the term "size grade" is often used synonymously with the term "weight break" to designate the grade of the article. The RUN ROUTINE also keeps a running count of the number of articles classified into each weight break F through L and keeps track of the total weight of the articles classified in each of the weight breaks F through L. The RUN ROUTINE further determines when the number of articles classified into a particular weight break has reached a desired package count previously entered by the operator.

The UPDATE ROUTINE utilizes data accumulated by the RUN ROUTINE, including article counts and weights, to determine how the weight cutoff values for weight breaks F through L should be altered to obtain the desired package counts weights selected by the operator.

Figure 2:
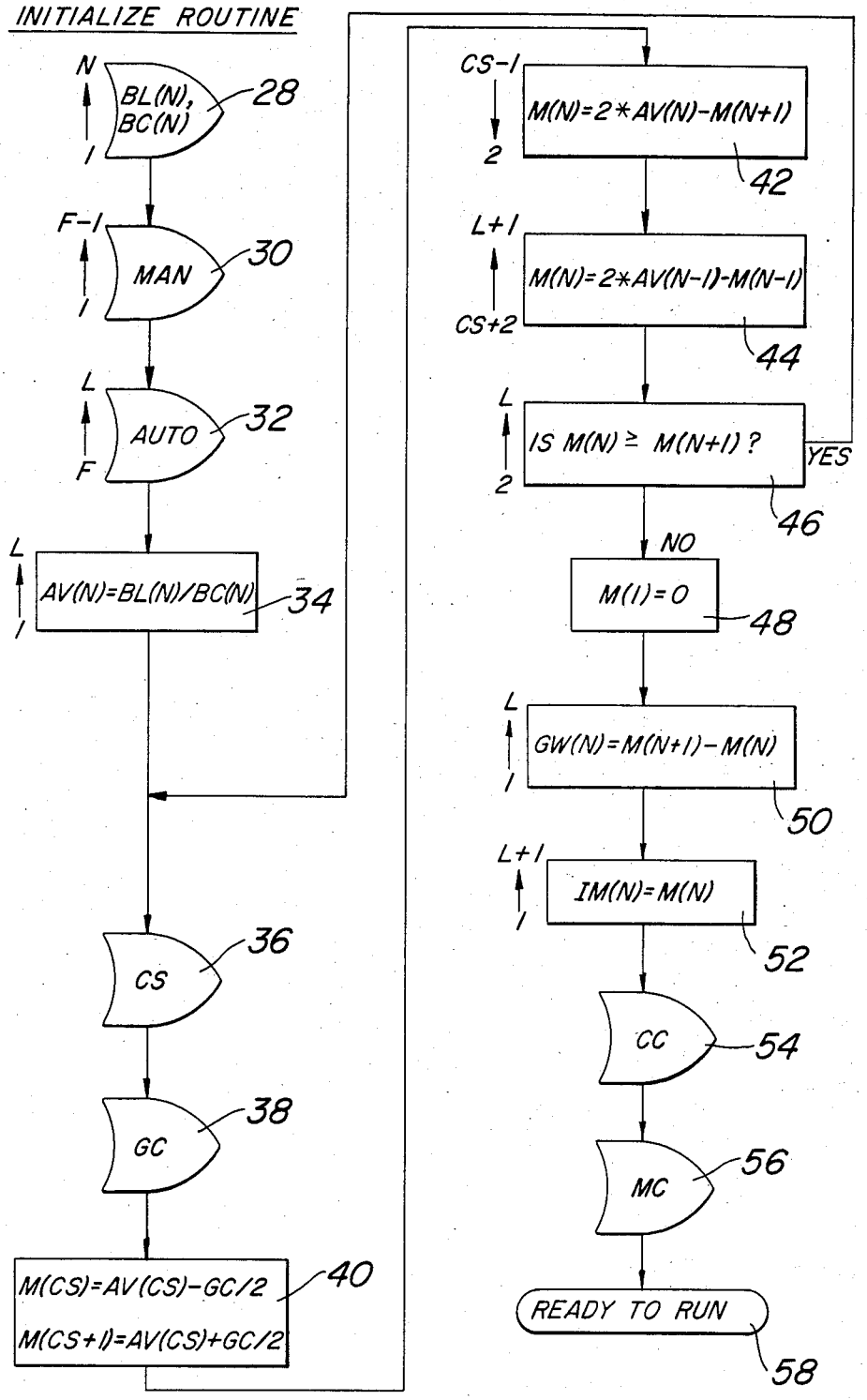
FIGS. 2, 3, 4A and 4B are flowcharts illustrating, step by step, the method of the present invention.

Referring now to FIG. 2, the INITIALIZE ROUTINE will be explained in detail.

At symbolic block 28, the operator enters, via keyboard 22, the desired package weight BL(N) for each weight break 1 through N, and the desired package count BC(N) for each weight break 1 through N. This is more fully illustrated in FIG. 5. In FIG. 5, the operator has selected 14 size grades or weight breaks and thus the value of N is 14. For each size grade N, the operator has selected a desired package BC and a desired package weight BL. Thus, for example, the operator has indicated that he desires 113 size 7 articles to weigh 41 pounds. Also as shown in FIG. 5, there is a weight cutoff value M associated with each size grade. The weight cutoff values M(N) are computed in a manner to be described hereinafter.

Returning to FIG. 2, control next passes to block 30 where the operator selects the sizes or weight breaks which are *not* to be under automatic control. This data is entered by means of the keyboard 22. Thus, as shown at symbolic block 30, sizes 1 through F−1 are not to be under automatic control. F−1 represents the size immediately preceding the first size F selected to be under automatic control. At symbolic block 32, the operator selects the sizes which are to be automatically controlled. Sequential sizes or weight breaks F through L will have their weight cutoff values automatically controlled, as will be explained. With reference to FIG. 5, the value of F may correspond to size 6 and the value of L may correspond to size 13. In this example, sizes 6 through 13 will have their weight cutoff values M automatically controlled.

At symbolic block 34, the desired average weight AV(N) of the articles in each size grade from size grade 1 to size grade L are calculated. This is achieved by dividing the desired package weight BL(N) by the corresponding desired package count BC(N) for each size grade N=1 through N=L.

Control passes to symbolic block 36 where the operator designates anyone of the sizes between 1 and L as a "control size", CS. The control size CS is also entered by means of the keyboard 22. The control size CS is used by the controller to automatically compute the weight cutoff values for all sizes 1 through N, as will be explained hereinafter. At symbolic block 38, the operator provides another value, designated the "gap width", GC. The gap width GC which the operator enters at this point is associated with the control size CS. As will become evident, there are also gap widths GW associated with the other sizes N≠CS.

By definition, the gap width GW for any size N is the difference between the weight cutoff value M for the immediately succeeding size (i.e., M(N+1)) and the size under consideration (i.e., M(N)). For example, referring to FIG. 5, the gap width GW associated with size 7 (i.e., GW(7)) is 0.380−0.346=0.034. Also, as shown in FIG. 5, the operator has selected size 9 as the control size CS. The gap width GC for the control size is 0.489−0.420=0.069.

By selecting both a control size CS and a gap width GC for the control size, initial weight cutoff values M for all sizes from sizes 1 through N can be computed. Any size from N=1 through N=L may be selected as the control size CS. An initial value for the control size gap width GC may be obtained in a number of ways, either emperically or through experience or by means of the following formula:

$$GC = \frac{[(AVG\ CS) - (AVG\ CS - 1)] + [(AVG\ CS + 1) - (AVG\ CS)]}{2}$$

where:

GC=gap width for control size CS

AVG CS=desired average weight of articles in the control size CS (see symbolic block 34)

AVG CS−1=desired average weight of articles in size N immediately preceding control size CS (see symbolic block 34)

AVG CS+1=desired average weight of articles in size N immediately succedding control size CS (see symbolic block 34).

After the operator has selected or computed a value for GC, the weight cutoff value M for the control size, M(CS), and the weight cutoff value for the immediately succeeding size, M(CS+1) are computed according to the formula shown at symbolic block 40. Thus, the weight cutoff value M for the control size, M(CS), is determined by dividing the value of the control size gap width GC by two and subtracting the quotion thereof from the desired average weight for the control size, AV(CS). The weight cutoff value M for the immediately succeeding size, M(CS+1) is determined by dividing the value of the control size gap width GC by two and adding the quotion thereof to the desired average weight for the control size, AV(CS).

Control next passes to symbolic block 42 where the weight cutoff values for the weight breaks or sizes N preceding the control size CS (i.e., sizes 2 through CS−1) are established. As shown in block 42, for each weight break or size N between 2 and CS−1 inclusive, the weight cutoff value M(N) is obtained by multiplying the desired average weight AV(N) for the size N under consideration by 2 and subtracting therefrom the weight cutoff value M(NH) corresponding to the immediately succeeding weight break N+1. For example, referring to FIG. 5, the value of M(8) is 2*(40/100)−0.420=0.380. Thus, by starting with size CS−1 and working backwards toward size 2, the weight cutoff values M(N) for sizes 2 through CS−1 can be established.

Control passes to block 44 where the weight cutoff values for sizes CS+2 through L+1 are established. For each of these sizes, the weight cutoff values M(N) are established by multiplying the desired average weight corresponding to the immediately preceding weight break (i.e., AV(N−1)) by 2 and subtracting therefrom the weight cutoff value M corresponding to the immediately preceding weight break (i.e., M(N−1)). For example, referring to FIG. 5, the value of M(CS+2) is 2*(40/80)−0.489=0.511. Thus, by starting with size CS+2 and working forward to size L+1, the weight cutoff values M(N) for sizes CS+2 through L+1 can be established.

At symbolic block 46, the weight cutoff values M(N) for each of the sizes 2 through L are compared to their immediately succeeding weight break values M(N+1) (i.e., for N=2 through L the value of M(N) is compared to the value of M(N+1)). This is done to insure that the weight cutoff values M(N) just established are acceptable. If the weight cutoff value M for any size N is greater than the weight cutoff value M for the immediately succeeding size N+1, there is an error. In such a case, the before described process symbolized by blocks 36–44 must be repeated until acceptable weight values are obtained. Thus, block 46 is a check to insure that none of the weight cutoff values "cross", i.e., that the weight cutoff values M successively increase in value for sizes 1 through N.

If the weight cutoff values are acceptable, control passes to block 48. At block 48, the weight cutoff value for the first size, i.e., size 1, is set to 0. Thus, once control has reached block 48, weight cutoff values M have been established for all sizes N. Control then passes to block 50 where gap widths GW for sizes 1 through L are determined. Except for the control size gap width GC, the gap width GW for each size 1 through L, is established by subtracting the weight cutoff value M for the size N under consideration from the weight cutoff value for the succeeding size N+1. For example, referring to FIG. 5, GW(5)=0.294−0.279=0.015.

At symbolic block 52, the initial weight cutoff values M for sizes 1 through L+1, as computed at blocks 42, 44 and 48, are stored in a new array labelled IM(N) for later use.

Control next passes to symbolic block 54 where the operator provides a value for the label CC. The value of CC represents the total number of articles which must be processed by the sorting machine before the UPDATE routine will be executed. A typical value for CC is 2000, but this value is empirically chosen and may be changed.

Control next passes to symbolic block 56 where the operator enters a value for the label MC. The value of MC is used to determine which sizes or weight breaks N=F through N=L are ready to have their weight cutoff values M modified. This will be explained in detail hereinafter. A typical value for MC is 50, but again this value is empirically chosen and may be changed.

The values of CC and MC may be set by the operator via keyboard 22.

Control next passes to symbolic block 58 which instructs the controller that control may now pass to the RUN routine.

Figure 3:
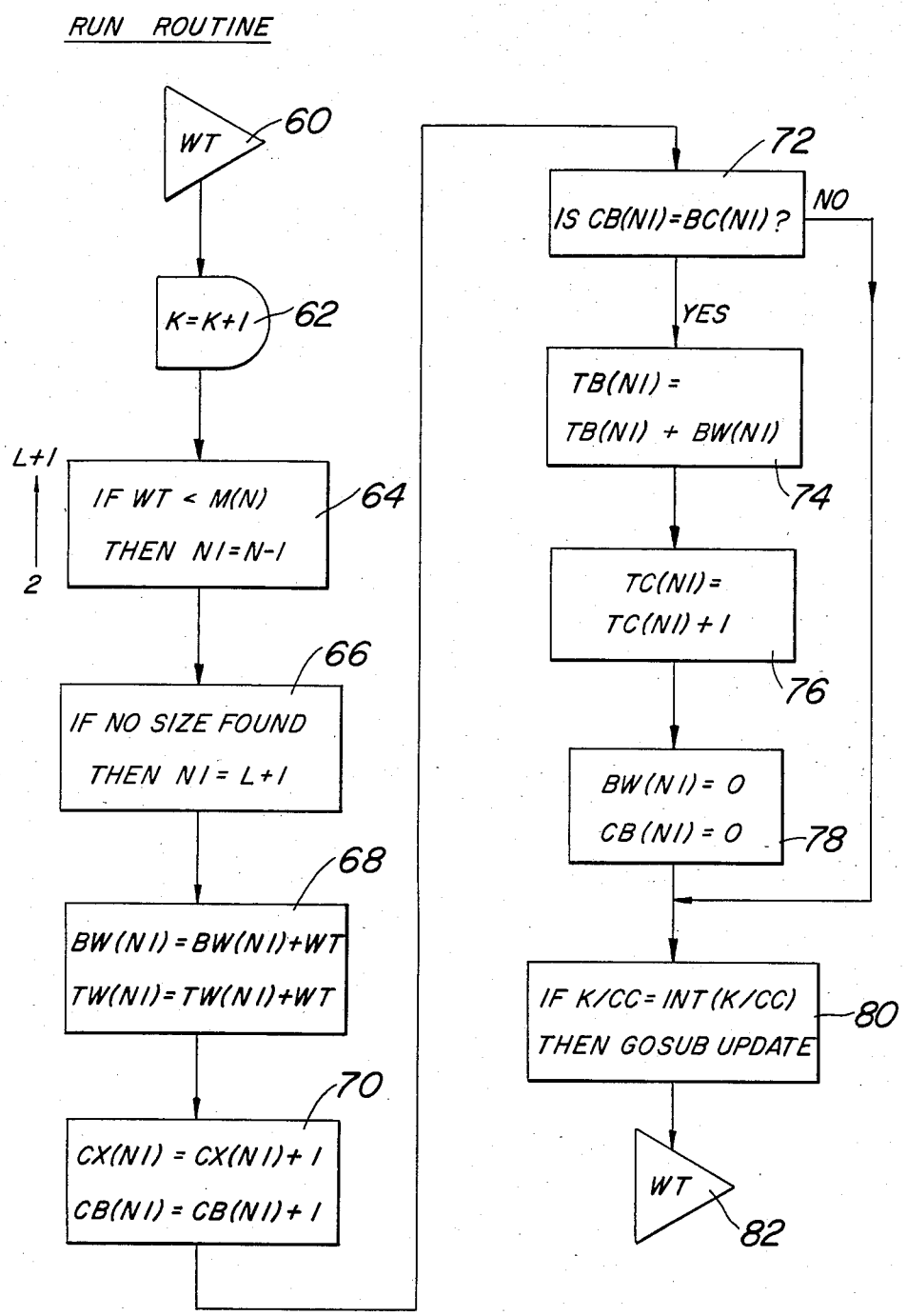
Figure 4A:
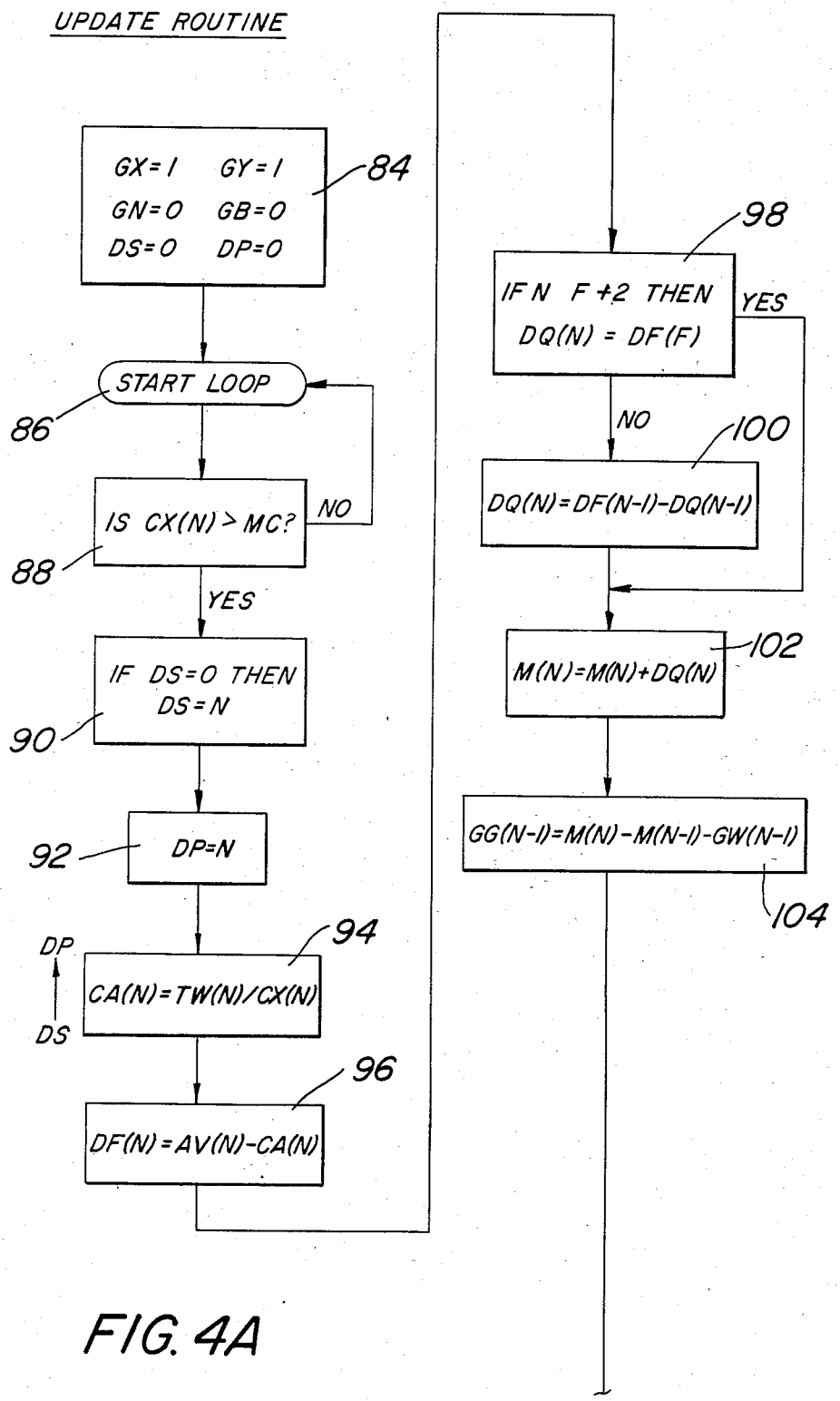
Figure 4B:
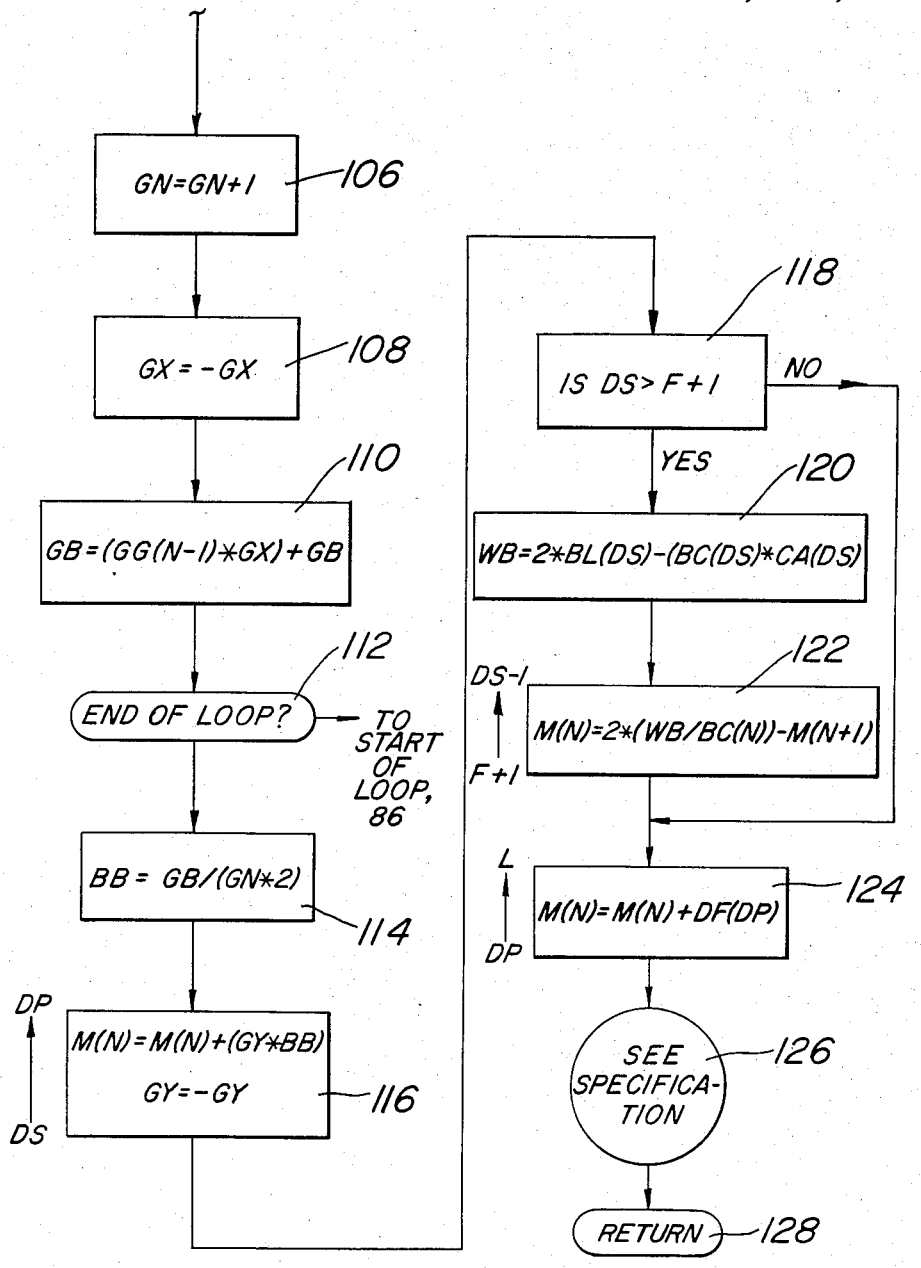

The RUN routine is illustrated in FIG. 3. As explained in aforementioned U.S. Pat. No. 4,106,628, shaft encoder 20 provides an indication that a cup is in position over the weighing platform 14 for weighing the article contained therein. The RUN routine is executed each time an article is weighed at the weighing platform 14.

As illustrated at symbolic block 60, when an article passes over scale 14, its weight is obtained and supplied to the controller for processing. As previously explained, the article weight supplied by the scale 14 represents the weight of both the article and the cup. Microcomputer 18 is programmed to subtract the tare weight of the cup from the combined weight of the cup and article to provide the weight of the article alone.

Control passes to symbolic block 62 where a counter K is incremented by 1. Counter K keeps track of the total number of articles that have been weighed.

At block 64, the article is classified into one of the weight breaks or size grades N. This is achieved by comparing the actual weight WT of the article, as obtained at block 60, to each of the weight cutoff values M(N). The size grade or weight break into which the article is classified is assigned a label, N1. Thus, as shown at block 64, the article weight WT is first compared to the weight cutoff value M(N) for the highest size grade, then to the weight cutoff value M(N−1) for the size grade, etc., until a weight cutoff value M(N) is reached which exceeds the article weight WT. It will be appreciated that since the comparison begins with the weight cutoff value M(N) for the largest size grade and proceeds backwards toward the smallest size grade, once a weight cutoff value M(N) is found which exceeds the aritcle weight WT, the size grade of the article is size N−1. Thus, the article is classified into one of the sizes 1 through N and the label N1 is assigned to the size grade to which the article has been classified.

Control then passes to block 66 which classifies the article into size L+1 if step 64 failed to find a size grade for the article.

At symbolic block 68, two values are updated. The first value, designated BW(N1) is the "box weight". The value of BW(N1) represents the weight of size grade N1 articles thus far accumulated in size grade N1 for the next box or container to be packaged. The value of TW(N1) represents the total weight of all size grade N1 articles which have been acculated in size grade N1 since the beginning of the sorting procedure. Thus, for example, if the operator had selected a value of 40 for BL(N1) at step 28, the value of BW(N1) would always be somewhere between 0 and 40. On the other hand, the value of TW(N1) may exceed the value of BL(N1), since it represents total accumulated weight. The values of BW(N1) and TW(N1) are updated at block 68 by adding thereto the weight WT of the article just weighed at the scale 14 according to the size grade into which the article has been classified.

Control passes to symbolic block 70. Counters CX(N1) and CB(N1) are associated with each size grade N1. Thus, depending upon which one of the size grades N1 the article has been classified into, appropriate ones of the counters CX(N1) and CB(N1) will be incremented. The value of CX(N1) represents the total number of all size grade N1 articles which have been accumulated in size break N1 since the beginning of the sorting operation. The value CB(N1) represents the number of size grade N1 articles thus far accumulated in size break N1 for the next box or container to be packaged. Thus, for example, if the operator had selected a value of 100, for BC(N1) at step 28, the value of CB(N1) would always be somewhere between 0 and 100. On the other hand, the value of CX(N1) may exceed the value of BC(N1) since it represents total accumulated number of articles.

At symbolic block 72, the value of CB(N1) is compared to the value BC(N1) entered at symbolic block 28 of the INITIALIZE routine. Thus, symbolic block 72 performs a check to determine whether the desired package count for size N1 has been reached. If the value of CB(N1) equals the value of BC(N1), control passes to symbolic block 74 where the package weight for packages of size N1 is updated. Thus, symbolic block 74 provides a value TB(N1) which represents the combined weight of all packages thus far produced in size N1. Control passes to symbolic block 76 which computes the total number of packages produced for size N1. Thus, the value of TC(N1) is value representative of the total number of packages produced in size N1 since the sorting process began.

Control then passes to symbolic block 78 where the values of BW(N1) and CB(N1) are zeroed. It will be appreciated that the values assigned to BW(N1) and CB(N1) will not be set to 0 unless it was determined at block 72 that the actual package count CB for size N1 is equal to the desired package count BC for size N1. Control then passes to block 80 where the value of counter K (which keeps track of the total number of articles weighed on the sorting machine (see symbolic block 62) is divided by the value of CC (the cycle counter) to determine whether the UPDATE subroutine should be entered. If the value of K is a multiple of the value of CC, the UPDATE subroutine is entered. On the other hand, if the value of K is not a multiple of the value of CC, control passes to block 82 then to block 60 where the next article is weighed and processed in the aforementioned manner.

It will be appreciated that the values assigned to the variables established in FIG. 3 are updated each time an article weight WT is obtained. The only time that any of the variables are reset to 0 is when coincidence between an actual package count CB and a desired package count BC is determined. Thus, the RUN routine keeps track of the total number of articles which have been packaged in each size grade, the total number of articles in the container currently being packaged, the total weight of articles packaged in each size grade, and the total weight of articles in the container currently being packaged. This information is used by the UPDATE routine for the purpose of modifying the weight cutoff values M(N) to achieve uniform package count and package weight. However, the UPDATE routine is not entered unless the value of the counter K (which is an indication of the total number of articles thus far weighed) is a multiple of the cycle counter CC.

FIGS. 4A–4B illustrate the operation of the UPDATE routine.

When the UPDATE routine is entered, control immediately passes to symbolic block 84. At symbolic block 84, six variables GX, GN, DS, GY, GB and DP are set to the values shown at block 84. Control next passes to symbolic block 86 which together with symbolic block 88 operates as a loop to determine the smallest size grade N within the controlled sizes L through F into which there have been classified the minimum number of articles MC set by the operator at symbolic block 56. The smallest size grade N within the controlled sizes F through L which has at least the minimum number MC of articles classified therein is designed as size DS. Stated otherwise, when loop 86, 88 is first entered, the value of N is F. Each time through the loop, the value of N is incremented until a controlled size or weight break between F and L is found which has an article count CX equal to or greater than the minimum count MC set by the operator. When this occurs, the loop is exited and, at symbolic block 90, the label DS is assigned to the lowest size F through L having the minimum count MC.

In the example of FIG. 5, size 7 has been found to be the lowest size to have reached the minimum count MC, and therefore this size is designated DS.

Before proceeding further, it should be explained that steps 86 through 112 define a loop which is executed for each of the sizes starting with the size DS and ending with one of the controlled sizes F through L which will be designated size DP. Thus, each time through the loop 86, 112, the steps indicated in FIGS. 4A and 4B are executed for the next size. Thus, the first time through the loop, the functions indicated in loop 86, 112 will be performed for size DS. The next time through the loop the functions indicated will be performed for size DS+1, and so forth up to and including size DP. An assumption is made at block 88 that for all sizes N between DS and DP, the count CX has reached or exceeded the value of MC, so this test is not actually performed for sizes DS<N<DP. Thus, block 88 really tests for the smallest and largest sizes, DS and DP respectively, which have reached the maximum count MC and assumes that all sizes therebetween have also reached the minimum count MC.

At symbolic blocks 90 and 92, the size N currently under consideration is assigned to the variable DP. It will be appreciated that, by virtue of the loop operation defined by blocks 86–112, the value of DP will always be equal to the present size being operated upon, but on the last pass through the loop 86–112, the value of DP will be equal to the greatest size that has reached the minimum count MC.

At symbolic block 94, the actual average weight CA of the articles in size N is computed (size N is the same as the size DS the first time through the loop 86–112).

The actual average weight CA for the size N, also designated CA(N), is computed by dividing the total accumulated weight TW(N) for size N by the article count CX(N) for size N. As will be appreciated, this is performed for all sizes DS through DP by virtue of loop 86–112.

At symbolic block 96, the difference between the actual average weight CA(N) for size N and the desired average weight AV(N) for size N is calculated and assigned a label DF(N). This function is also performed for all of the sizes DS through DP by virtue of loop 86–112.

Control then passes to symbolic block 98. At symbolic block 98 it is determined whether the current size N being operated upon is either size F or F+1. If the current size being operated upon is F or F+1, a label DQ(N) is assigned the value of DF for size F, or stated otherwise, assigned the value of DF(F) computed at block 96. Thus, for sizes F and F+1, the value DQ(N) is equal to the value of DF (F). In the example of FIG. 5, the values of DQ(6) and DQ(7) are both set equal to the value of DF(6).

If the current size N under consideration is not size F or size F+1, control passes to block 100 where the value of DQ for size N (where: $F+2 \leqq N \leqq DP$) is computed according to the formula shown. Thus, for every size between sizes F+2 and DP, inclusive, the value of DQ(N) is computed by subtracting the value of DQ(N−1) from the value DF(N−1). This is performed by starting with size N=F+2 and working successively forward to size DP each time through loop 86–112.

Control then passes to block 102 where the weight cutoff values M(N) for sizes DS through DP are modified. Thus, for sizes DS through DP, the minimum weights M(N) are modified by adding thereto the corresponding values of DQ(N).

As a result of having calculated new weight cutoff values M(N) at block 102 for sizes DS through DP, new gap widths GW(N)′ will result. At block 104, the deviation between the new gap widths GW(N)′ and the desired gap widths GW(N) established at symbolic block 50 are determined. The deviation between the new and the old gap widths is designated GG and is computed as follows. The deviation GG(N−1) for the size N-(which immediately preceeds the size N under consideration) is computed by subtracting the new weight cutoff value M(N−1) for the size N−1 from the new weight cutoff value M(N) for the size N, and subtracting therefrom the gap width GW(N−1) for size N−1. Again, since step 104 is in the loop 86–112, this step will be performed for each of the sizes DS through DP.

Control next passes to block 106 where a counter GN keeps track of the number of times through this loop. The counter GN actually keeps track of the number of sizes N which have been operated upon by this loop. Thus, this last time through the loop, the value of GN will be equal to the number of sizes between DS and DP, inclusive.

At block 108, the sign of label GX, which was set to +1 at symbolic block 84 is inverted. It will be appreciated that the value of GX will alternate from +1, to −1, to +1, to −1, etc. each time through the loop 86–112.

Control next passes to symbolic block 110 where successive deviations GG(N) (as computed at symbolic block 104) are alternately added together and subtracted from each other each time through the loop 86–112. The result of this "alternating summation" is a value labelled GB. Thus, the first time through the loop, GB=−GG(DS−1); the second time through the loop, GB=GG(DS)−GG(DS−1); the third time through the loop, GB=−GG(DS+1)+GG(DS)−GG(DS−1); etc.

Control passes to block 112 which indicates that the loop 86–112 is to be repeated for the next size grade N+1 unless size DP has been reached and operated upon. When the last size DP has been operated upon, control passes to symbolic block 114. At block 114 a minimizing constant BB is computed. The value of the minimizing constant is set equal to the value of GB divided by twice the value of the counter GN. Stated otherwise, the minimizing constant BB is defined as the result of the "alternating sum" GB divided by twice the number of sizes between DS and DP, inclusive.

After the minimizing constant BB has been calculated, control passes to block 116 where the weight cutoff values M(N) for sizes DS through DP are readjusted using the minimizing constant BB. Thus, the weight cutoff value M(N) for each size DS through DP is again modified by either adding thereto or subtracting therefrom the value of the minimizing constant BB. For the first size DS, the minimizing constant BB is added to the value of M(DS), since the value of GY is +1, to arrive at a new value of M(DS). For size DS+1, the minimizing constant is subtracted from the weight cutoff value M(DS+1) since the value of GY is −1, to arrive at a new minimum weight value M(DS+1). Thus, it will be appreciated that for size DS+2, the minimizing constant BB will be added to the present value of M(DS+2) to arrive at a new value M(DS+2) etc. The process is repeated, with the sign of GY alternating, until size DP has been reached. Control then passes to block 118.

At block 118 it is determined whether size DS is greater than size F+1. If size DS is greater than size F+1, control passes to block 120. Otherwise, control passes to block 124.

Blocks 120–124 contain the steps required to readjust the weight cutoff values M(N) for the sizes between F+1 and DS−1 inclusive (symbolic block 122) and for the sizes between DP and L conclusive (symbolic block 124). That is, these steps readjust the weight cutoff values for those sizes designated by the operator to be automatically controlled but which have not reached the minimum count MC.

At symbolic block 120, a constant WB is computed by multiplying the value of the desired package count BC for size DS by the actual average weight CA of the articles in size DS and subtracting the resulting value from twice the desired box weight BL for size DS. After the value WB has been computed at step 120, the weight cutoff values for sizes DS−1 through F+1 are computed according to the equation shown at symbolic block 122. This equation results in new weight cutoff values M(N) for sizes F+1 through DS−1. Control then passes to block 124 where the weight cutoff values M(N) for sizes DP through L are computed according to the equation shown therein. This equation results in new weight cutoff values M(N) for sizes DP through L.

At block 126, all of the weight cutoff values M(N) for sizes 1 through N are checked to determine whether any weight breaks have "crossed". This check is made in similar fashion to the check described at block 46. That is, a check is made to insure that the weight cutoff value for each size N+1 is greater in value than the weight cutoff value for the size N. If the check determines that any weight cutoff values have "crossed", both are set to the weight cutoff value for size N+1.

Control then passes via block 128 to the normal control algorithm for the sorting machine. Each time the weight cutoff values are modified according to the present method, the microcomputer 18 causes some articles 26 to be discharged at different locations than they would have been if the old weight cutoff values had not been disturbed. Thus, articles are distributed at different discharge locations according to their actual weight and according to the new weight cutoff values computed according to the present method.

The present invention may be embodied in other specific forms without departing from the spirit or essential attributes thereof and, accordingly, reference should be made to the appended claims rather than to the foregoing specification, as indicating the scope of the invention.

I claim:

1. A method for automatically adjusting plural successive weight cutoff values defining plural successive weight breaks into which articles are to be classified according to their weight for use in an article sorting machine of the type having a scale over which the articles are transported for providing article weight data, a controller receiving and processing the article weight data and classifying the articles into ones of the weight breaks, and plural discharge stations having means responsive to the controller for discharging each article at a selected one of the discharge stations for packaging, the method comprising the steps of (a) providing values indicative of the desired average weight of the articles to be classified in each weight break;

(b) computing values indicative of the actual average weight of the articles classified into each weight break based upon the weight data provided by the scale;

(c) computing the differences between successive weight break cutoff values, each difference corresponding to a weight break and defining a gap width;

(d) computing the difference between the desired average weight and the actual average weight for each weight break;

(e) performing a first adjustment to the magnitude of the weight cutoff values by an amount determined by the magnitude of the differences between the desired average weights and actual average weights, the result of the first adjustment defining preliminary modified weight cutoff values;

(f) performing a second adjustment to the magnitude of the weight cutoff values by an amount determined by the magnitude of the gap widths, the result defining final modified weight cutoff values;

(g) discharging the articles at selected ones of the discharge stations based upon the modified weight cutoff values and the actual weight of the articles.

2. Method according to claim 1 wherein the step of performing the second adjustment comprises;

(a) computing a minimizing constant having a value reflective of the overall change in the gap widths occurring as a result of performing the first adjustment; and (b) alternately adding and subtracting the minimizing constant to selected successive ones of the preliminary weight cutoff values.

3. Method according to claim 1 wherein the step of providing values indicative of the desired average weight of the articles to be classified in each weight break comprises entering via a user operable data entry means data indicative of the number and weight of articles to be packaged at each discharge location and computing the desired average weight of the articles based on the entered data.

4. Method according to claim 1 wherein the step of computing values indicative of the actual average weight of the articles classified into each weight break comprises:

(a) keeping track of the number of articles classified into each weight break;

(b) keeping track of the total weight of the articles classified into each break;

(c) periodically dividing the total weight of the articles classified into each weight break by the corresponding number of articles classified into each weight break.

5. A method of adjusting selected ones M(F) through M(L) of weight cutoff values M(N) defining plural weight breaks N into which articles are to be classified according to the actual weight WT, where N is an integer value greater than 1, for use with an article sorting machine of the type having a scale over which the articles are transported for obtaining a measurement of each article's actual weight WT, a controller for determining into which one of the weight breaks N each article should be classified based on each article's actual measured weight WT, and a plurality of selectively actuatable discharge stations for discharging each article at a selected location based on its weight break classification for packaging the articles, the method comprising the steps of:

(a) providing via a user operable data entry means data indicative of desired package count BC and desired package weight BL of the articles to be packaged at each discharge location;

(b) designating a plurality of successive weight breaks, F through L, of the N weight breaks to be automatically controlled;

(c) computing the desired average weight AV of the articles to be classified into each of the weight breaks based upon the values of BL and BC;

(d) designating one of the weight breaks F through L as a control size, CS;

(e) providing an initial value representing the difference between the weight cutoff value M(CS) for the control size CS and the weight cutoff value M(CS+1) for the weight break CS+1 immediately succeeding the control size CS, the difference defining a control size gap width GC;

(f) determining initial weight cutoff values M(N) for each weight break N based upon the values of GC and AV;

(g) determining the difference between each weight cutoff value M(N+1) and the immediately preceding weight cutoff value M(N) and defining each difference as a gap width GW(N);

(h) comparing the actual weight WT to the weight cutoff values M(N) and classifying each article into one of the weight breaks N;

(i) maintaining a count CX of the actual number of articles classified into each weight break N and a running sum TW of the weight of the articles classified into each weight break;

(j) determining the first and last weight breaks, DS and DP respectively, between the weight breaks F and L, to have classified therein a pre-selected number MC of articles;

(k) computing the actual average weight CA of the articles classified into weight breaks DS through DP based upon the respective values of TW and CX, and computing the differences DF(N) between the desired average weights AV(N) and the actual average weight CA(N) for the articles classified into weight breaks DS through DP;

(l) modifying the weight cutoff values M(N) corresponding to the weight breaks DS through DP in accordance with the differences DF(N);

(m) determining the difference between each modified weight cutoff value M(N) and the immediately preceding modified weight cutoff value M(N−1) for the weight breaks between DS and DP and subtracting therefrom the gap width GW(N−1) corresponding to the immediately preceding weight cutoff value M(N−1), the result defining a deviation GG(N−1) corresponding to the weight break N−1;

(n) alternately adding and subtracting each of the deviations GG(N−1) for each weight break DS through DP and dividing the result by a multiple of the number of weight breaks between DS and DP inclusive, the result of the division defining a minimizing constant BB;

(o) remodifying the weight cutoff values M(DS) through M(DP) inclusive by alternately adding to and subtracting from each of the modified weight cutoff values M(DS) through M(DP) the value of the minimizing constant BB;

(p) defining a value WB by multiplying the desired package count BC(DS) for the weight break DS by the actual average weight CA(DS) for the the weight break DS and subtracting the result from a multiple of the desired box weight BL(DS) for the weight break DS;

(q) modifying the weight cutoff values M(F+1) through M(DS−1) corresponding to weight breaks F+1 through DS−1 by, for each such weight break, dividing the value of WB by the corresponding desired package count BC, obtaining a multiple of the result and subtracting therefrom the weight cutoff value M(N+1) for the immediately succeeding weight break N+1;

(r) modifying the weight cutoff values M(N) corresponding to weight breaks DP through L by, for each such weight break, adding the difference DF(DP) for weight break DP to the original value of M(N);

(s) discharging the articles at selected ones of the discharge stations based upon the weight breaks defined by the modified weight cutoff values and the actual weight of the articles.

6. Method according to claim 5 further comprising the steps of examining each of the modified weight cutoff values M(N), determining if the modified cutoff value M(N) for each weight break N is greater than the weight cutoff value M(N+1) for the immediately succeeding weight break N+1 and setting the weight cutoff value M(N) equal to the weight cutoff value M(N+1) if the weight cutoff value M(N) exceeds the weight cutoff value M(N+1).

7. Method according to claim 5 wherein the initial value of GC is computed according to the equation:

$$GC = \frac{[AV(CS) - AV(CS-1)] + [AV(CS+1) - AV(CS)]}{2}$$

where:

AV(CS)=the desired average weight AV of articles to be classified in the control size CS;

AV(CS+1)=the desired average weight AV of articles to be classified in the weight break CS+1 immediately succeeding the control size CS;

AV(CS−1)=the desired average weight AV of articles to be classified in the weight break CS−1 immediately preceding the control size CS.

8. Method according to claim 5 wherein the initial weight cutoff value M(CS) for the control size CS is computed by subtracting a factor of the control size gap width GC from the desired average weight AV(CS) of articles in the control size CS.

9. Method according to claim 8 wherein the initial weight cutoff value M(N) for each weight break N preceding the control size CS is computed by subtracting the weight cutoff value M(N+1) for the weight break N+1 immediately succeeding the weight break N from a multiple of the desired average weight AV(N) of articles in the weight break N.

10. Method according to claim 5 wherein the initial weight cutoff value M(CS+1) for the weight break CS+1 immediately succeeding the control size CS is computed by adding a factor of the control size gap width GC to the desired average value AV(CS) of articles in the control size CS.

11. Method according to claim 10 wherein the initial weight cutoff value M(N) for each weight break N between weight breaks CS+2 and L+1 inclusive is computed by subtracting the weight cutoff value M(N−1) for the weight break N−1 immediately preceding the weight break N from a multiple of the desired average weight AV(N−1) of articles in the weight break N−1.

12. Method according to claim 5 further comprising the steps of:

(a) providing a value defining a cycle count CC;

(b) providing a counter for maintaining a count K of the number of articles weighed;

(c) performing steps (j) through (r) only when the count K is a multiple of the cycle count CC.

13. Method according to claim 5 wherein the step of modifying the weight cutoff values M(N) corresponding to the weight breaks DS through DP in accordance with the differences DF comprises the steps of:

(a) establishing variables DQ(N) and assigning the value of DF(F) to the variable DQ(F) and the value of DF(F+1) to DQ(F+1);

(b) computing values DQ(N) for each of the weight breaks N greater than the weight break F+1 by subtracting the value DQ(N−1) corresponding to the preceding weight break N−1 from the value DF(N−1) corresponding to the preceding weight break N−1;

(c) adding the value of DQ(N) corresponding to the weight break N to the weight cutoff value M(N) corresponding to the weight break N.

14. Method according to claim 5 wherein steps (h) through (s) are performed repeatedly.

* * * * *